US005436416A

United States Patent [19]

Fletcher

[11] Patent Number: 5,436,416

[45] Date of Patent: Jul. 25, 1995

[54] SEISMIC ELECTRICAL DISCONNECT

[76] Inventor: Clarence E. Fletcher, 216 B W. Elm Ave., Burbank, Calif. 91502

[21] Appl. No.: 257,536

[22] Filed: Jun. 9, 1994

[51] Int. Cl.[6] ..... H01H 35/14

[52] U.S. Cl. ..... 200/61.45 R; 200/61.45 M; 200/61.52

[58] Field of Search ..... 200/61.45 R, 61.53, 200/61.45 M, 61.83, 61.84

[56] References Cited

U.S. PATENT DOCUMENTS 4,524,287 6/1985 Brannen ..... 200/61.52 X

*Primary Examiner*—J. R. Scott

*Attorney, Agent, or Firm*—Joseph H. McGlynn

[57] ABSTRACT

A seismic electrical disconnect switch actuator assembly consisting of a magnet which holds a weight that will separate from the magnet when an earthquake occurs and will hit a door to which a cable is attached. The other end of the cable is attached to the main circuit breaker shut off switch. When the weight hits the door, the door opens, pulling the cable which pulls the main circuit breaker shut off switch into the off position.

10 Claims, 2 Drawing Sheets

SEISMIC ELECTRICAL DISCONNECT

BACKGROUND OF THE INVENTION

1. Field of the Invention

The present invention relates to a seismic switch activator assembly device and more particularly to a seismic switch activator assembly device that uses variable sensitivity controls to control the tripping of the main circuit breaker in a circuit breaker panel in case of an earthquake or its aftershocks. This will help prevent fires resulting from sparks from broken wires or fires from sparks igniting broken gas lines.

2. Description of the Prior Art

The devastating effects of seismic occurrences, such as earthquakes, are well known. Detectors are known which trigger alarms for warning workers in hazardous environments such as mines, construction sites or nuclear facilities. However these devices suffer the defects of triggering false alarms and there is no easy and reliable method for adjusting the sensitivity of such devices for seismic occurrences of various magnitudes in different areas or in the event of aftershocks.

SUMMARY OF THE INVENTION

The present invention consists of a triggering means for the main circuit breaker in a domestic or commercial circuit breaker box that is simple to install and can be used with all main circuit breakers no matter what the cut off direction of the breaker may be. Also, it includes a simple and effective sensitivity adjustment which can be used in areas of different seismic activity or in the event of aftershocks. The present invention can be quickly and easily attached to present circuit breaker boxes with zero modifications to most common boxes.

It is an object of the present invention to provide a seismic electrical disconnect switch actuator assembly that is easily installed on any circuit breaker box.

It is an object of the present invention to provide a seismic electrical disconnect switch actuator assembly that can be installed by someone other than a professional electrician.

It is an object of the present invention to provide a seismic electrical disconnect switch actuator assembly that can be adjusted for seismic occurrences of various magnitudes in different areas or in the event of aftershocks.

DESCRIPTION OF THE PREFERRED EMBODIMENT

Figure 1:
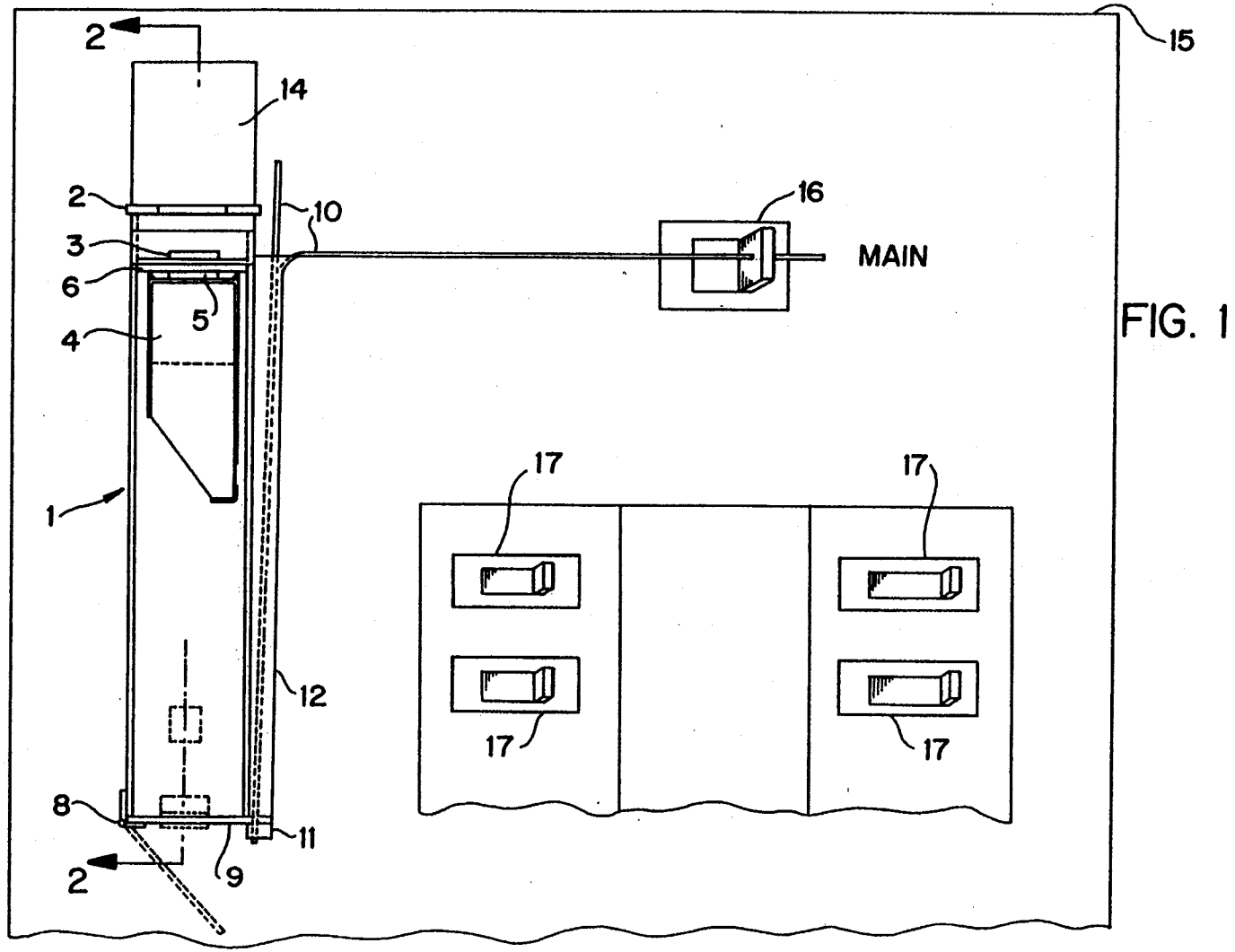
FIG. 1 is a front view of the Seismic Electrical Disconnect Switch Actuator Assembly mounted on the cover removed for clarity.

FIG. 1 shows the Seismic Electrical Disconnect Switch Actuator Assembly (SED) 1, without the cover. A magnet 3, is mounted near the top of the SED and supports a weight 4, which has a ferrous plate 5, attached at its top surface. The plate 5, can be eliminated if the weight is made from a ferrous material. Between the magnet and the weight is a slot which will accept the sensitivity shims 15, shown in FIG. 2, (only one of which is shown in the drawing). At the bottom of the SED is a door 9, mounted by means of a hinge 8. Attached to the door 9, at the end opposite the hinge 8, is a cable 10. The cable runs inside a channel 12, and exits at the top of the SED.

The cable 10, in FIG. 1 is shown as extending in two directions horizontally and vertically, however in use this cable will extent in only one direction depending on whether the main circuit breaker 16, mounted in circuit breaker panel 15, moves in a vertical or horizontal direction as it moves to the off position. That is, if the main circuit breaker moves in a horizontal direction as it is either turned on or off, the cable 10, will exit the top of the SED in a horizontal direction, either to the right or the left of the SED, depending on the location of the main circuit breaker. If the main circuit breaker moves in a vertical direction as it is either turned on or off, the cable 10, will exit the top of the SED in a vertical direction. The main circuit breaker 16, when it is tripped by the SED, will turn off all power to the individual circuit breakers 17.

Figure 3:
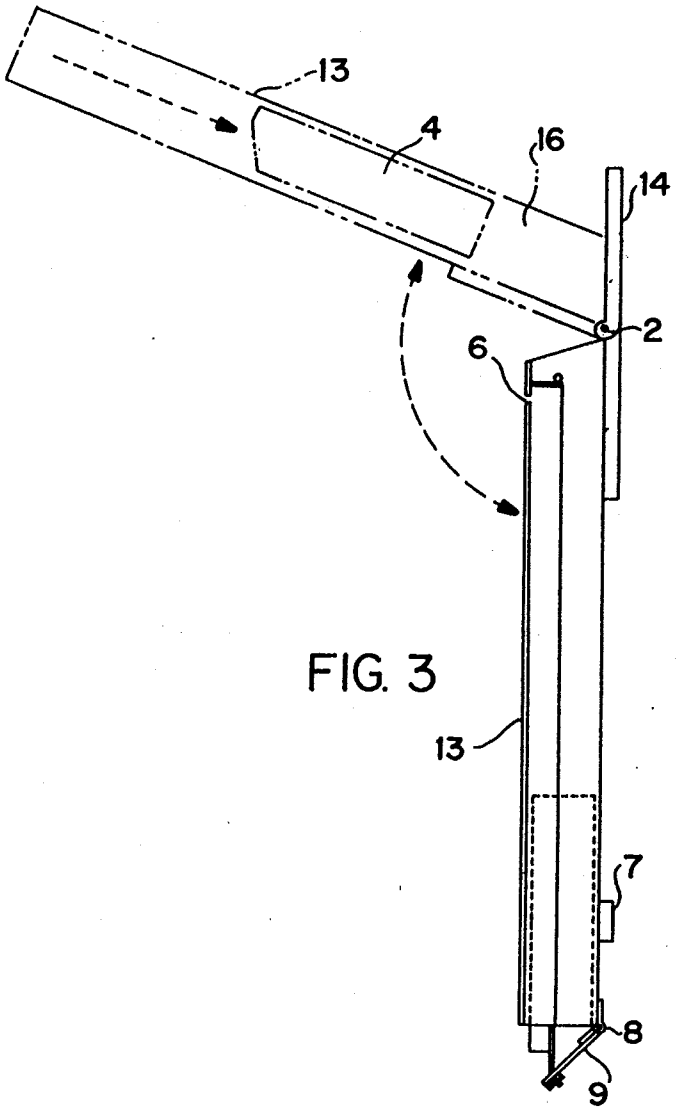
FIG. 3 is a side view showing the Seismic Electrical Disconnect Switch Actuator Assembly after it has been tripped and the manner of resetting the device.

The weight 4, has a portion closest to the hinge 8, removed so the full force of the weight will strike the door 9, farthest from the hinge 8. This will ensure that the door 9 will open under the impact of the weight and will move the cable 10 down, away from the top of the SED. The weight 4, rides in a channel 16, inside the cover 13, as shown in FIG. 3. The channel does not have to run the entire length of the cover. It only has to extend far enough to prevent the weight from falling out of the cover as the SED is being reset.

In use the SED will be attached to the face of the circuit breaker panel inside the circuit breaker panel cover, and will, therefore, be protected by the cover just as the circuit breakers are protected. The SED can be mounted using any conventional means, but double sided tape 14, is the most convenient because this eliminates the need for drilling holes by the installer. Since no holes will be drilled the average homeowner can install the SED without calling a professional electrician. Also a small magnet 7, can be used near the bottom of the SED to hold it against the face of the circuit panel this will prevent sway of the SED and accidental tripping of the main circuit breaker.

The weight 4, will be held by the magnet 3, until a seismic disturbance of sufficient magnitude occurs. The seismic disturbance will cause the weight 4, to separate from the magnet 3, and fall to the bottom of the SED until it hits the door 9. The force of the falling weight will cause the door 9, to pivot open, which will pull the cable 10, down the channel 12, which in turn will turn off the main circuit breaker.

It should be noted that the length of the cable 10, is selected so that the weight will force the door 9, open enough to operate the main circuit breaker, but it will not allow the door to be opened enough so that the weight will fall out of the bottom of the SED.

Figure 2:
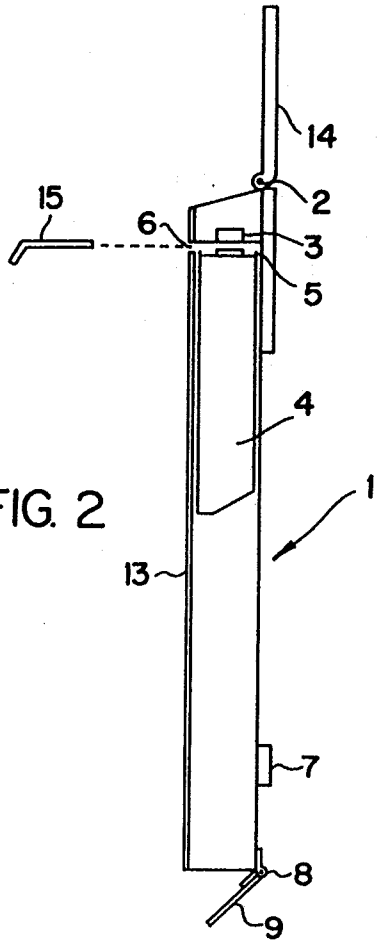
FIG. 2 is a cross-section of the Seismic Electrical Disconnect Switch Actuator Assembly showing one of the sensitivity shims.

The holding power of the magnet 3, can be adjusted to take into consideration the size of the seismic disturbance that will trip the main circuit breaker. In FIG. 2, a slot 6, is shown in the cover 13, that will accept shims 15 (only one of which is shown in the drawing). The shims can be color coded and/or marked with a number to indicate the strength of the sensitivity adjustment. This eliminates the guess work that would be associated with an adjustment means such as a screw. The user or installer can tell at a glance what sensitivity the magnet 3, is currently set for and, can easily and accurately change the setting at any time. This feature is important in the case of aftershocks which inevitably occur. Since the magnitude of the aftershocks are less than the magnitude of the earthquake, the original magnet setting may not be effective during an aftershock. The use of the sensitivity shims will provide a simple and effective method of setting the SED so that the main circuit breaker can be cut off during any aftershocks.

Once the SED has been tripped, it can be easily and quickly reset by simply pulling the bottom of the SED away from the face of the circuit breaker panel and swinging it upwards. As shown in FIG. 3, swinging the SED upwards will cause the weight to slide down (to the right in FIG. 3) until it is captured by the magnet 3 illustrated in FIGS. 1 and 2. The magnet 3, will hold the weight in position while the SED is moved back into position against the face of the circuit breaker panel, and the SED will be reset. The main circuit breaker can then be turned back on which will pull the cable 10, and the door 9, back into operating position.

Although the Seismic Electrical Disconnect Switch Actuator Assembly (SED) 1, and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A seismic electrical disconnect switch actuator assembly comprising: a housing adapted to be attached to the front panel of a circuit breaker box having a main circuit breaker cut off switch, a cover attached to said housing, a weight which slides within a channel behind said cover, means for holding said weight at one end of said channel, a door attached at the opposite end of said channel, a cable having one end attached to said door, the other end of said cable mechanically attached to said main circuit breaker cut off switch, whereby when a seismic disturbance occurs said weight will be shaken loose from said means for holding said weight and will fall onto said door which will open under the impact of said falling weight and will pull said cable which will turn off said main circuit breaker cut off switch.

2. The seismic electrical disconnect switch actuator assembly of claim 1, wherein said means for holding said weight is a magnet.

3. The seismic electrical disconnect switch actuator assembly of claim 1, wherein said housing is attached to said front panel of said circuit breaker box by double sided tape.

4. The seismic electrical disconnect switch actuator assembly of claim 1, wherein said weight is tapered on the end which faces said door.

5. The seismic electrical disconnect switch actuator assembly of claim 1, wherein said weight has a plate made from ferrous metal attached to the end which is closest to said means for holding said weight.

6. The seismic electrical disconnect switch actuator assembly of claim 1, wherein adjusting means is inserted between said means for holding said weight and said weight so that the holding strength of said means for holding said weight can be adjusted.

7. The seismic electrical disconnect switch actuator assembly of claim 10 wherein said adjusting means is a plurality of shims.

8. The seismic electrical disconnect switch actuator assembly of claim 6, wherein said shims are color coded.

9. The seismic electrical disconnect switch actuator assembly of claim 6, wherein said shims are number coded.

10. The seismic electrical disconnect switch actuator assembly of claim 6 wherein an opening is provided in said cover and said adjusting means is inserted first through said opening and then between said means for holding said weight and said weight.

* * * * *